US006068422A

United States Patent [19]

Smith

[11] Patent Number: 6,068,422

[45] Date of Patent: May 30, 2000

[54] ECOLOGICALLY BENEFICIAL REFILL FOR A PEN INCLUDING A LEVEL INDICATOR AND WRITEOUT SCALE

[75] Inventor: Paul A. Smith, Glenview, Ill.

[73] Assignee: Eversharp Pen Co., Franklin Park, Ill.

[21] Appl. No.: 09/176,995

[22] Filed: Oct. 22, 1998

[51] Int. Cl.[7] ..... B43K 29/00

[52] U.S. Cl. ..... 401/195; 401/192; 401/194; 401/141

[58] Field of Search ..... 401/192, 194, 401/210, 141, 142, 52

[56] References Cited

U.S. PATENT DOCUMENTS

| | | | |
|---|---|---|---|
| 1,409,613 | 3/1922 | Strasser | 401/194 |
| 1,783,681 | 12/1930 | Terry | 401/194 |
| 2,495,013 | 1/1950 | Martin | 401/194 |
| 5,236,749 | 8/1993 | Ewing | 428/35.2 |
| 5,486,390 | 1/1996 | Burns et al. | 428/40 |
| 5,615,964 | 4/1997 | Smith | 401/210 |

FOREIGN PATENT DOCUMENTS

| | | | |
|---|---|---|---|
| 165418 | 9/1955 | Australia | 401/194 |
| 2609666 | 7/1988 | France | 401/192 |

*Primary Examiner*—David J. Walczak
*Attorney, Agent, or Firm*—Patents & TMS, P.C.

[57] ABSTRACT

A refill is provided that is packaged in a recyclable assembly of recyclable plastic and recyclable paper or cardboard. The refill is further constructed from recyclable plastic and uses soy resins for the ink. On a barrel of the ink refill is a graduated scale indicative of the amount of writeout of ink remaining in the pen. In addition, a follower, such as a floating ball or chemical chaser, clearly identifies the level of ink remaining in the refill. The assembly may further include a scale corresponding to the scale on the refill and may further include information relating to the recyclability utilization of the assembly and refill.

19 Claims, 1 Drawing Sheet

ECOLOGICALLY BENEFICIAL REFILL FOR A PEN INCLUDING A LEVEL INDICATOR AND WRITEOUT SCALE

BACKGROUND OF THE INVENTION

The present invention generally relates to a refill for a writing instrument. More specifically, the present invention relates to a refill for a writing instrument that is ecologically beneficial and provides means for identifying level of ink contained therein and/or a writeout scale.

It is, of course, generally known to provide refills for, for example, pens. Known refills, however, do not have any ecological properties, advantages or characteristics; therefore, current refills are simply disposable. That is, refills are typically purchased for replacement in a pen, for example, that has been depleted of ink. The refill is placed into the pen, and the pen and refill are used in combination until the refill is depleted of ink. A consumer typically disposes of the refill once depleted and purchases another refill.

Often, the ink in the refill is not completely depleted. In addition, a consumer rarely is aware of the amount of ink left in the refill. Moreover, consumers typically are not aware of the amount of "writeout" for specific levels of ink left in a pen or refill. Often, ink within the refill clings or smears along interior walls of the refill making it difficult to determine when the refill will be depleted and out of ink.

A need, therefore, exists for an improved refill that overcomes the deficiencies of known refills including providing a refill that is ecologically beneficial as well as providing a refill that readily identifies the amount of writeout as well as accurately identifying the ink level of the refill.

SUMMARY OF THE INVENTION

The present invention provides a refill that is ecologically beneficial as well as a refill that provides an indication of writeout in an accurate manner.

To this end, in an embodiment of the present invention, a pen refill is provided. The pen refill has an elongated barrel that has a first end and a second end defining an interior wherein the first end is a writing tip. Ink is contained with the interior of the barrel, and a level indicator in the interior of the barrel is capable of advancing with the ink in the interior of the barrel from a point intermediate the first end and the second end and toward the first end.

In an embodiment, a graduated scale associated with the barrel identifies various levels of the ink.

In an embodiment, the level indicator is a ball capable of floating at the level of the ink and advancing in the interior of the barrel as the level decreases.

In an embodiment, the level indicator is a chemical compound that follows the ink without mixing with the ink and advances with the level of the ink as the ink decreases in the interior of the barrel.

In an embodiment, a plurality of marks associated with the barrel identifies various levels of the ink wherein one of the plurality of marks is distinct from a remainder of the plurality of marks.

In an embodiment, the ball is constructed from plastic.

In an embodiment, the barrel is constructed from recyclable plastic.

In an embodiment, the barrel is transparent.

In an embodiment, the level indicator is distinctly colored from the ink.

In another embodiment of the present invention, a packaged refill assembly is provided. The packaged refill assembly has a recyclable paper layer and a recyclable plastic layer wherein the plastic layer attaches to the paper layer. A pen refill is sandwiched between the paper layer and the plastic layer. The refill includes a writing end and an opposite end that defines a length having an interior. Ink is contained within the interior of the refill. A graduated scale is associated with the refill that identifies various levels of the ink remaining in the interior of the refill.

In an embodiment, a plurality of marks is provided to identify the various levels wherein at least one of the plurality of marks is distinct from a remainder of the plurality of marks.

In an embodiment, a level indicator in the interior of the refill is capable of advancing with the ink in the interior of the refill.

In an embodiment, a ball in the interior of the refill is capable of floating at the level of the ink and advancing in the interior of the refill as the level decreases.

In an embodiment, a chemical compound is capable of following the ink without mixing with the ink and further is capable of advancing with the level of the ink as the ink decreases in the interior of the barrel.

In an embodiment, the ball is constructed from plastic.

In an embodiment, the ball is distinctly colored from the ink.

In an embodiment, the chemical compound is distinctly colored from the ink.

In an embodiment, a scale is associated with the paper layer which corresponds to the graduated scale associated with the refill.

In an embodiment, information on the paper layer relates to the recyclability of the assembly.

It is, therefore, an advantage of the present invention to provide a refill that is ecologically beneficial.

Moreover, an advantage of the present invention is to provide a refill that accurately identifies the level of ink remaining in the pen.

A still further advantage of the present invention is to provide a refill that includes a graduated scale identifying the amount of ink remaining in a pen.

Still further, the present invention provides a refill that is sold and packaged using ecologically friendly and/or recyclable materials.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

The present invention generally provides a refill that is ecologically beneficial as well as a refill that clearly and accurately identifies the level and amount of ink remaining in the refill before depletion thereof.

Figure 1:
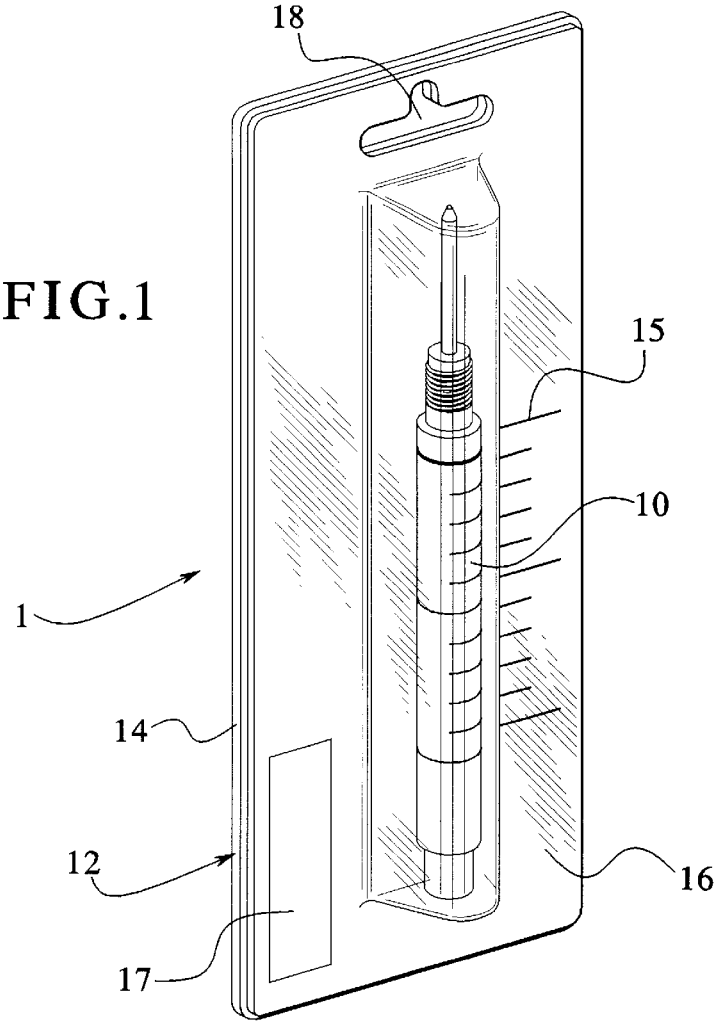
FIG. 1 illustrates a perspective view of a refill packaged for purchase in an embodiment of the present invention.

Referring now to the drawings wherein like numerals refer to like parts, FIG. 1 generally illustrates a packaged refill assembly 1 including a refill 10 within a "blister card" 12. The blister card 12 is constructed from a recyclable paper or cardboard backing 14 and a transparent or translucent recyclable plastic cover 16 such that the refill 10 may be visualized through the cover 16 of the card 12. Both the backing 14 and the cover 16 are constructed from recyclable materials to provide a recyclable and ecologically friendly packaging for the refill 10. An aperture 18 may be provided through the cover 16 and the backing 14 for suspension of the packaged refill assembly 1 for sale and/or display.

In a preferred embodiment, the backing 14 or the cover 16 may be printed with a graph or scale 15 corresponding to marks 24 and 26*a*–26*c* on the refill itself. Adjacent the scale 15 may be printed information on the refill 10 in "real" or "practical" terms for a consumer to interpret. The marks 24 and 26*a*–26*c*, which will be described hereinafter, identify the "writeout" remaining in the refill 10. However, the scale 15 and its corresponding marks on the backing 14 on the cover 16 may identify "writeout" in terms of the number of written pages or words that a certain writeout level corresponds to. Such real or practical information is more readily understood by, for example, the consumer purchasing the refill 10.

In addition, the backing 14 or the cover 16 may also be printed or otherwise provided with information relating to the utilization of the refill 15 as a recyclable. For example, the refill 15 and its packaging, in a preferred embodiment, is constructed from plastic, paper, soy ink and brass (the writing end of the refill). To this end, the backing 14 or the cover 16 may include an area 17 that includes information regarding the recyclability of the assembly 1 including the refill 10 in terms of written information that details facts regarding the same or a graph or chart of its utilization as a recyclable within the area 17. The information may be presented for each or all of the components, either separately or collectively. Of course, the information may be printed anywhere on the assembly 1 and is not limited to printing or otherwise designated in the area 17 as specified in FIG. 1.

Figure 2:
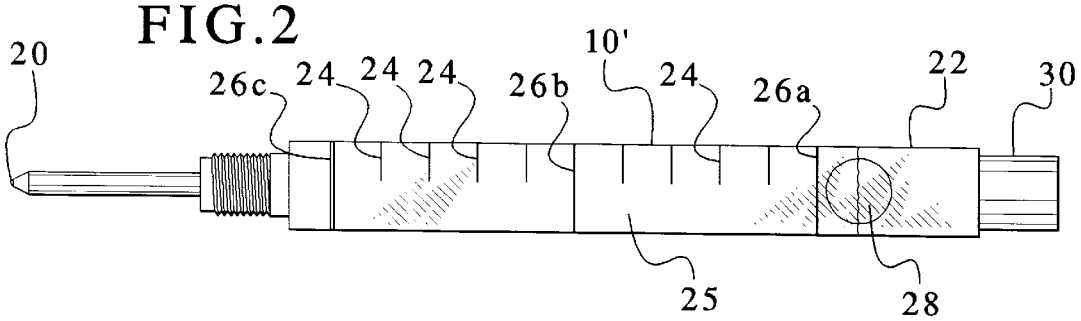
FIG. 2 illustrates a plan view of a refill having a graduated scale and level indicator in another embodiment of the present invention.

FIG. 2 illustrates an embodiment of a refill 10'. The refill 10' includes a writing tip 20 to which ink 25 contained within the interior of the refill 10' flows for use as a writing instrument or within a writing instrument. Preferably, the refill 10' is constructed from a transparent plastic barrel 22.

Imprinted or otherwise designated on the barrel 22 may be graduated marks 24 indicative of a scale. One or more marks 26*a*, 26*b* or 26*c* may be provided and are distinct from the marks 24 indicative of a specific designation or amount of ink remaining in the refill 10'. For example, mark 26*a* designates a full level of ink within the refill 10', mark 26*b* indicates a designation where the level of the ink 25 remaining in the refill 10' is half full, and mark 26*c* indicates when the writeout of the ink 25 is nearly depleted. Typically, writeout is designated in terms of the feet of ink for which the pen is capable of writing. A rather typical writeout for a refill is two miles, or approximately, 10,000 feet. The designation 26*a* may, therefore, also include a numerical designation associated therewith. For example, 26*a* may identify 10,000 feet of writeout; the mark 26*b* may identify 5,000 feet of writeout left remaining in the pen or refill 10'; and the mark 26*c* may designate 1,000 feet of writeout remaining in the pen or refill 10'. Therefore, the consumer may readily identify the amount of ink 25 left in the refill 10'.

The amount of ink 25 may further or alternatively be identified by use of a ball 28. The ball 28 acts as a follower of the ink as it is depleted from the refill 10'. Preferably, the ball 28 is made from a plastic, such as the specialty plastic Delrin, sold and manufactured by Hoover Precision Products.

To this end, the ball 28 floats at the level of the ink 25 in the interior of the refill 10'. As the ball 28 advances, a consumer may readily visualize the level of ink 25 remaining in the refill 10'. Further, the ball 28 may be and is preferably distinct in color from the ink 25. In a preferred embodiment, the ball 28 is green and acts as a reminder of the ecological "friendliness" of the refill 10'.

As previously set forth, the barrel 22 of the refill 10' is preferably transparent, recyclable plastic. In addition, the end opposite the writing tip 20 may be fitted with a retractable adapter 30 as generally illustrated. The retractable adapter 30 encloses the end of the refill 10' and functions to align or orient itself with a retract mechanism, for example, of a pen body.

Figure 3:
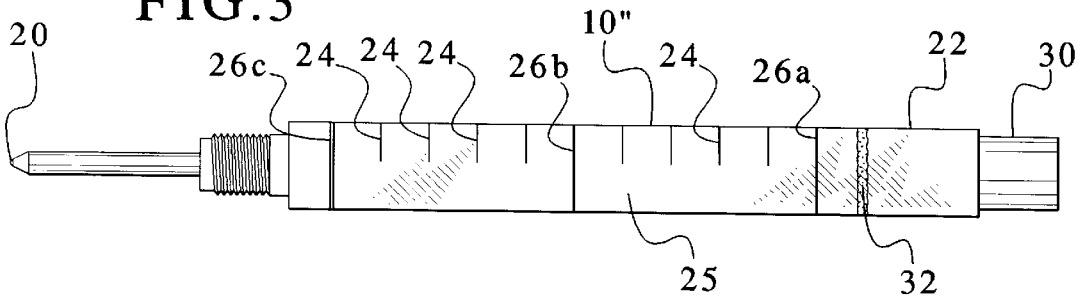
FIG. 3 illustrates a plan view of a refill having a level indicator and graduated scale in another embodiment of the present invention.

Referring now to FIG. 3, another refill 10" is illustrated. The refill 10" is substantially identical to the refill 10' in FIG. 2. However, the refill 10" includes a chemical follower or chaser 32 of the ink 25 contained within the interior of the barrel 22. The chemical chaser 32 is preferably a colored grease that follows the ink 25 as the ink 25 is depleted through use of the refill 10". Preferably, again, the chaser 32 is a distinct color from that of the ink 25 and, in a preferred embodiment, the chaser 32 is green. In a preferred embodiment, the chaser is a chemical compound, typically a viscous material, such as a silicone grease. The chaser 32 follows the ink 25 as the level thereof decreases in the refill 10"; however, the chaser 32 does not mix with the ink 25 in the refill 10". A graduated scale may also be provided on the barrel of the refill 10", to indicate the amount of writeout remaining in the refill 10".

Preferably, the ink 25 used in the refill is a soy ink resin that is biodegradable and, hence, ecologically beneficial. Such inks are currently not used within refills.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

We claim:

1. A pen refill comprising:

an elongated barrel having a first end and a second end defining an interior wherein the first end is a writing tip;

ink contained within the interior of the barrel disposed between the first end and a point intermediate the first end and the second end wherein the ink has a level;

a level indicator in the interior of the barrel capable of advancing with the ink in the interior of the barrel from the point intermediate the first end and the second end and toward the first end wherein the level indicator is visible through the barrel at the level of the ink; and a graduated scale associated with the barrel identifying various levels of the ink.

2. The refill of claim 1 wherein the level indicator is a ball capable of floating at the level of the ink and advancing in the interior of the barrel as the level decreases.

3. The refill of claim 2 wherein the ball is constructed from plastic.

4. The refill of claim 1 wherein the level indicator is a chemical compound that follows the ink without mixing with the ink and advances with the level of the ink as the ink decreases in the interior of the barrel.

5. The refill of claim 1 wherein the graduated scale has:

a plurality of marks associated with the barrel identifying various levels of the ink wherein one of the plurality of marks is distinct from a remainder of the plurality of marks.

6. The refill of claim 1 wherein the barrel is constructed from recyclable plastic.

7. The refill of claim 1 wherein the barrel is transparent.

8. The refill of claim 1 wherein the level indicator is distinctly colored from the ink.

9. A packaged refill assembly comprising:

a recyclable paper layer;

a recyclable plastic layer wherein the plastic layer attaches to the paper layer;

a pen refill sandwiched between the paper layer and the plastic layer wherein the refill includes a writing end and an opposite end defining a length having an interior;

ink within the interior of the refill;

a graduated scale on the packaged refill assembly associated with the refill identifying various levels of the ink remaining in the interior of the refill.

10. The assembly of claim 9 further comprising:

a plurality of marks identifying the various levels wherein at least one of the plurality of marks is distinct from a remainder of the plurality of marks.

11. The assembly of claim 9 further comprising:

a level indicator in the interior of the refill capable of advancing with the ink in the interior of the refill.

12. The assembly of claim 9 further comprising:

a ball in the interior of the refill capable of floating at the level of the ink and advancing in the interior of the refill as the level decreases.

13. The assembly of claim 12 wherein the ball is constructed from plastic.

14. The assembly of claim 12 wherein the ball is distinctly colored from the ink.

15. The assembly of claim 12 further comprising:

information disposed on the paper layer indicating that the assembly is recyclable.

16. The assembly of claim 9 further comprising:

a chemical compound capable of following the ink without mixing with the ink and further capable of advancing with the level of the ink as the ink decreases in the interior of the barrel.

17. The assembly of claim 16 wherein the chemical compound is distinctly colored from the ink.

18. The assembly of claim 9 further comprising:

a scale associated with the paper layer which corresponds to the graduated scale associated with the refill.

19. A packaged refill assembly comprising:

a recyclable paper layer;

a recyclable plastic layer wherein the plastic layer attaches to the paper layer;

a pen refill sandwiched between the paper layer and the plastic layer wherein the refill includes a writing end and an opposite end defining a length having an interior;

ink within the interior of the refill;

a graduated scale associated with the refill identifying various levels of the ink remaining in the interior of the refill;

a ball in the interior of the refill capable of floating at the level of the ink and advancing in the interior of the refill as the level decreases; and a scale associated with the paper layer which corresponds to the graduated scale associated with the refill.

* * * * *